US005551887A

United States Patent [19]

Nankoh et al.

[11] Patent Number: 5,551,887

[45] Date of Patent: Sep. 3, 1996

[54] CONNECTOR

[75] Inventors: Yuichi Nankoh; Hajime Kawase, both of Yokkaichi, Japan

[73] Assignee: Sumitomo Wiring Systems, Ltd., Suzuka, Japan

[21] Appl. No.: 419,365

[22] Filed: Apr. 10, 1995

[30] Foreign Application Priority Data

Apr. 20, 1994 [JP] Japan ..... 6-106085

[51] Int. Cl.[6] ..... H01R 29/00

[52] U.S. Cl. ..... 439/188

[58] Field of Search ..... 439/188, 489, 439/490; 200/51.09

[56] References Cited

U.S. PATENT DOCUMENTS

| | | | |
|---|---|---|---|
| 4,884,978 | 12/1989 | Inabs et al. . | |
| 4,906,203 | 3/1990 | Margrave et al. | 439/188 |
| 5,263,872 | 11/1993 | Marpoe Jr. et al. | 439/188 |
| 5,435,748 | 7/1995 | Abe | 439/188 X |
| 5,466,168 | 11/1995 | Liebich et al. | 439/188 |

FOREIGN PATENT DOCUMENTS

| | | | |
|---|---|---|---|
| 624930 | 11/1994 | European Pat. Off. | 439/513 |

*Primary Examiner*—Jes F. Pascua

*Attorney, Agent, or Firm*—Anthony J. Casella; Gerald E. Hespos

[57] ABSTRACT

In order to prevent a connector capable of keeping a short-circuited state released even if a movable member for releasing a short-circuited state is disengaged, (+)- and (−)-supply terminals 4 are short-circuited by a short-circuit terminal 5 in an apparatus side connector housing 2. When a movable member 3 is rotated to its locking position, the apparatus side connector housing 2 is coupled with a supply side connector housing 1. Simultaneously, a pressing portion 33 presses the short-circuit terminal 5, thereby releasing the short-circuited state, with the result that an apparatus can be connected in an operative state. An elastic locking portion 56 of the short-circuit terminal is engaged with an engaging projection 15. Thus, even in the event where the movable member 3 is disengaged, the short circuit state can remain released since the engaging projection 15 acts to hold the short-circuit terminal 5 out of contact with the supply terminals 4.

10 Claims, 4 Drawing Sheets

CONNECTOR

BACKGROUND OF THE INVENTION

1. Field of the Invention

The present invention relates to a connector capable of short-circuiting supply terminals mounted in an apparatus side connector housing while the apparatus side connector housing is detached from a supply side connector housing.

2. Description of the Prior Art

It is necessary to conduct maintenance, inspection and wiring for an electric circuit for an apparatus such as an air bag without activating the apparatus. Such an operation is performed after separating a supply side connector housing connected with a power source and an apparatus side connector housing connected with the apparatus. If an induced current caused by external magnetic and/or electric fields flow into the electric circuit during this operation, the apparatus wrongly operates. A connector is known in which (+)- and (–)-supply terminals mounted in the apparatus side connector housing are short-circuited to prevent such a wrong operation when both connector housings are separated from each other.

For example, in a connector shown in FIG. 6, a lever 73 for releasing a short-circuiting state is rotatably mounted on a supply side connector housing 71. In the illustrated connector, the lever 73 is in its locking position where it extends along the outer surface of the housing 71. In an apparatus side connector housing 72, two supply terminals 74 (only one supply terminal is shown in FIG. 6) are mounted side by side. A short-circuit terminal 75 is mounted below the supply terminals 74. The short-circuit terminal 75 is elastically in contact with the supply terminals 74. When the connector housings 71 and 72 are coupled and the lever 73 is rotated to its locking position, a pressing portion 76 of the lever 73 presses the short-circuit terminal 75 downward as shown FIG. 6, thereby releasing the short-circuited state between the supply terminals 74, 74 and establishing an electrical connection between the connector housings 71 and 72.

Since the prior art short-circuit terminal 75 is pressed by the lever 73 to release the short-circuited state, it acts to the short-circuited state, it acts to short-circuit the supply terminals 74, 74 in the absence of a pressing force from the lever 73. In other words, the apparatus may not operate if a certain external force acts on the lever 73 exposed at the outer surface of the supply side connector housing 71, thereby bringing the lever 73 out of its locking position, when the power source and the apparatus are connected by means of this connector.

In view of the above problem, it is an object of the invention to provide a connector in which a short-circuited state remain released even if a lever for releasing the short-circuited state is disengaged when a supply side connector housing and an apparatus side connector housing are coupled with each other, so that an apparatus is not brought into an inoperative state.

SUMMARY OF THE INVENTION

A connector in accordance with the subject invention includes (+)- and (–)-supply terminals which are mounted in an apparatus side connector housing and which are short-circuited by a short-circuited terminal. The apparatus side connector housing is coupled to a supply side connector housing, and a movable member then is moved to a locking position. The movable member presses the short-circuit terminal to release the short-circuited state, with the result that an apparatus is kept in an operative state by a current from a power source. The short-circuit terminal which is pressed by the movable member to get out of contact with the supply terminals is engaged with an engaging portion formed at the supply side connector housing. If a certain external force is exerted on the movable member, thereby bringing the movable member out of its locking position, then the movable member cannot press the short-circuit terminal any longer. However, since the engaging portion holds the short-circuit terminal out of contact with the supply terminals, the short-circuited state remains released.

Conclusively, the engaging portion formed at the supply side connector housing engages and retains the short-circuit terminal so as not to short-circuit the supply terminals. Accordingly, the apparatus is not brought into an inoperative state even if the movable member is brought out of its locking position.

According to a preferred embodiment, since the movable member is formed with the coupling member for coupling the apparatus side connector housing with the supply side connector housing, the short-circuit state can be released by coupling the connector housings and the connector is allowed to have excellent operability.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

A connector of this embodiment includes a supply side connector housing 1 to be connected with an unillustrated power source and an apparatus side connector housing 2 to be connected with an unillustrated apparatus such as an air bag. A movable member 3 which acts to release a short-circuited state is rotatably mounted on the supply side connector housing 1.

Figure 1:
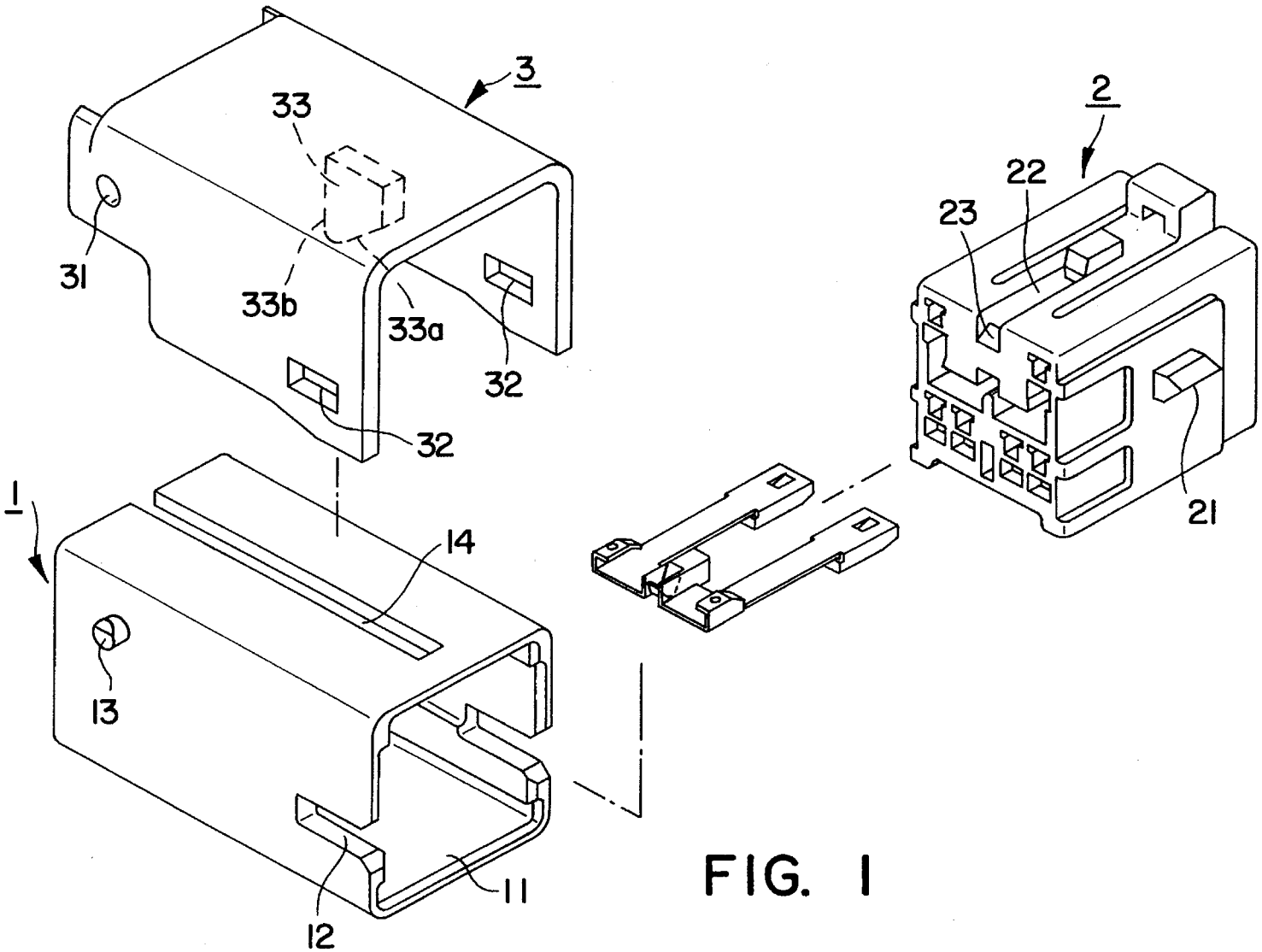
FIG. 1 is an exploded perspective view of a connector according to the invention.

As shown in FIG. 1, the supply side connector housing 1 is formed at its front part with a receptacle 11 into which the apparatus side connector housing 2 is insertable. At the opposite lateral side walls of the receptacle 11, there are formed slits 12 which extend backward from the front edge of the receptacle 11. Locking projections 21 formed on the apparatus side connector housing 2 are engageable with the corresponding slits 12. At a rear part of the supply side connector housing 1, support shafts 13 project outward from the outer surfaces of the opposite lateral side walls. The movable member 3 is rotatably mounted on the supply connector housing 1 by engaging holes 31 formed in the movable member 3 with the support shafts 13. Further, a groove 14 is formed on the upper wall of the receptacle 11 and an engaging projection 15 (engaging portion) is formed on the inner surface of the bottom wall of the receptacle 11 (see FIG. 3).

The movable member 3 is formed to have a U-shaped cross-section, such that it can cover the upper and opposite lateral surfaces of the receptacle 11. The movable member 3 is rotatable about the support shafts 13 between a locking position where it extends along the outer surfaces of the receptacle 11 and a disengaged position where it is away from the receptacle 11. At the lateral side walls of the movable member 3, there are formed locking holes 32 which conform to the slits 12 when the movable member 3 is in its locking position. Further, a pressing portion 33 projects inward from the inner surface of the upper wall of the movable member 3. The pressing portion 33 projects into the interior of the receptacle 11 through the groove 14 when the movable member 3 is rotated to its locking position. Slanting guide surfaces 33*a* and 33*b* are formed at front and rear edges of the leading end of the pressing portion 33, respectively.

The apparatus side connector housing 2 is of such a substantially box-like shape that it can be inserted into the receptacle 11, and is formed with the locking projections 21 engageable with the locking holes 32 formed in the opposite lateral side walls of the movable member 3. When the apparatus side connector housing 2 is inserted into the receptacle 11, the locking projections 21 are fitted into the corresponding slits 12 and then engaged with the locking holes 32 of the movable member 3, thereby coupling the connector housings 1 and 2. An opening 22 into which the pressing portion 33 of the movable member 3 is inserted is formed in the upper surface of the apparatus side connector housing 2. When the movable member 3 is rotated to its locking position after the connector housings 1 and 2 are coupled, the pressing portion 33 enters the opening 22 through the groove 14 to press a short-circuit terminal 5 to be described later. At the front end of the opening 22, there is formed an engaging portion 23 which comes into contact with the slanting guide surface 33*b* of the pressing portion 33 entering the opening 22 so that the apparatus side connector housing 2 is forced into the receptacle 11, with the result that the connector housings 1 and 2 can be securely coupled. On the other hand, if the apparatus side connector housing 2 is insufficiently inserted into the receptacle 11, the slanting guide surface 33*a* comes into contact with the engaging portion 23, thereby pressing the apparatus side connector housing 2 out of the receptacle 11. Thus, a coupling failure is easily detectable.

By engaging locking projections 21 with the locking holes 32 and engaging the engaging portion 23 with the pressing portion 33, the apparatus side and supply side connector housings 1 and 2 can be lockingly coupled with each other.

Figure 3:
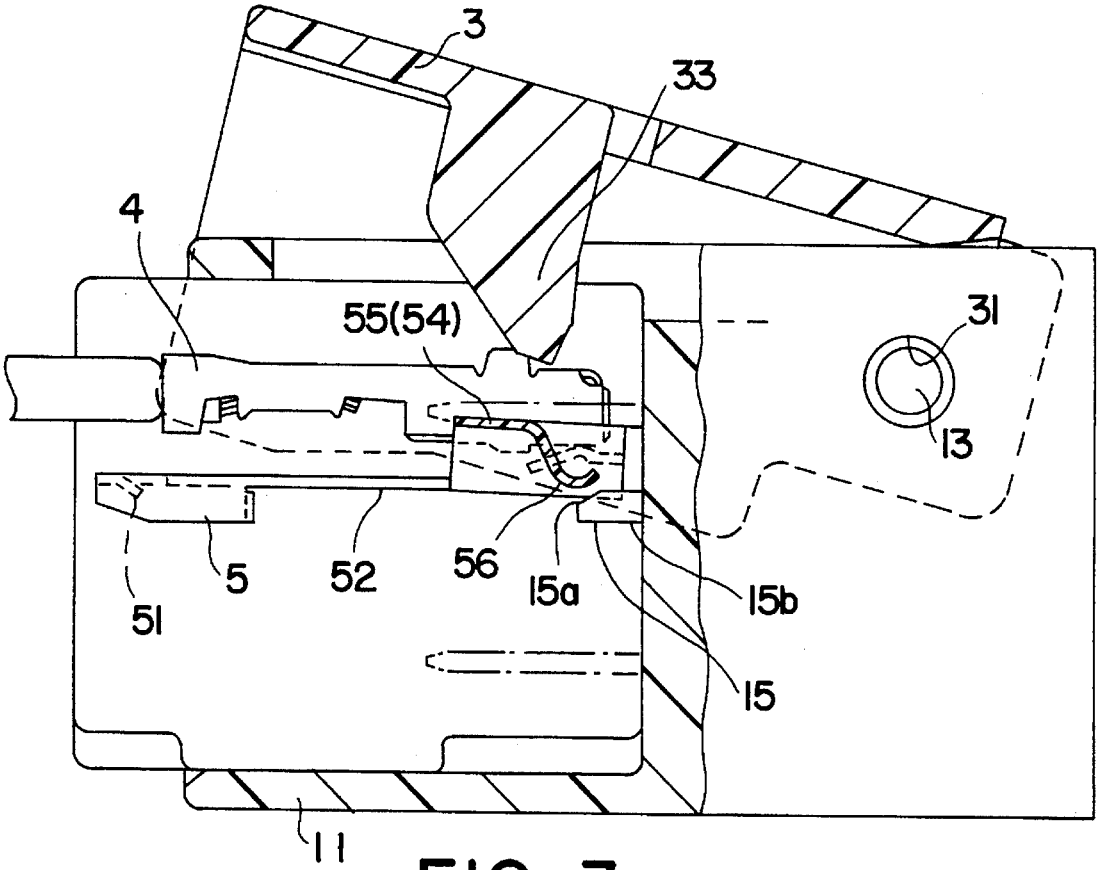
FIG. 3 is a section of the connector before the coupling is performed with an apparatus side connector housing omitted.

Two cavities (unillustrated) for supply terminals are formed horizontally in side-by-side relationship in the apparatus side connector housing 2. Two supply terminals 4, 4 are mounted in these cavities as shown in FIG. 3. Below these cavities, there are formed two cavities (unillustrated) for a short-circuit terminal. A short-circuit terminal 5 is mounted in these cavities.

Figure 2:
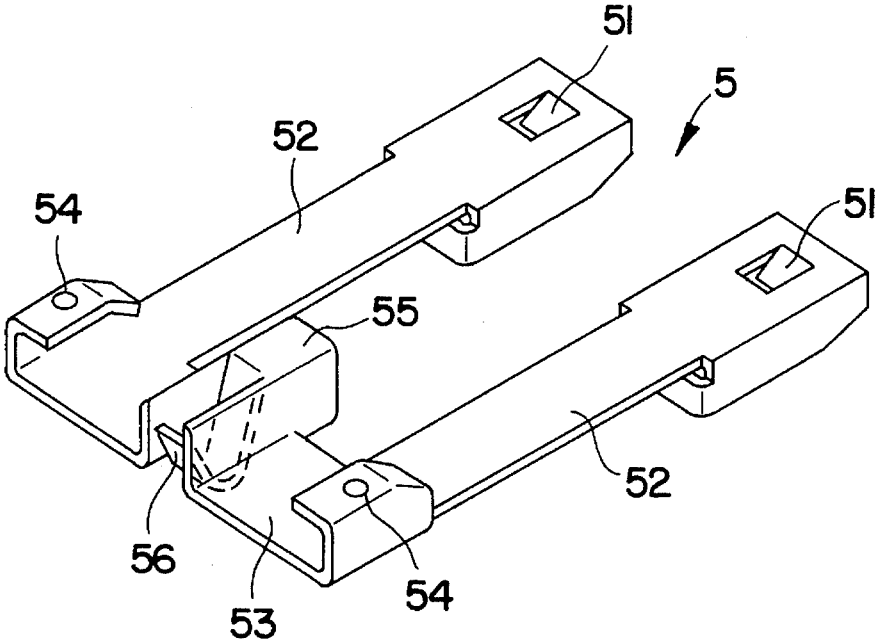
FIG. 2 is a perspective view of a short-circuit terminal.

The short-circuit terminal 5 is formed by folding a thin conductive metal plate material. As shown in FIG. 2, the terminal 5 includes two mounts 51, 51 locked in the cavities therefor, two elastic arms 52, 52 extending forward from the corresponding mounts 51, 51, a connecting portion 53 for connecting front ends of the arms 52, 52, two contact portions 54, 54 which are formed at the connecting portion 53 and come into contact with the lower surfaces of the supply terminals 4, 4, a portion 55 which is intermediate between the contact portions 54 and 54 and with which the pressing portion 33 of the movable member 3 comes into contact, and an elastic locking portion 56. The locking portion 56 extends obliquely downward in the forward direction from the portion 55 and is curved at its intermediate portion so that the front end thereof inclines upward.

The short-circuit terminal 5 formed as described above is mounted in the cavities therefor with the mounts 51 locked in the cavities. As shown in FIG. 3, the contact portions 54, 54 which are made elastically deformable in the vertical direction by the elastic arms 52, 52 come into contact with the lower surfaces of the supply terminals 4, 4, thereby short-circuiting the supply terminals 4, 4. In the mounted position of the terminal 5, the portion 55 faces the opening 22 so that it can be pressed by the pressing portion 33 of the movable member 3 entering the opening 22, and the locking portion 56 is located above the engaging projection 15 (engaging portion) projecting from the inner surface of the bottom wall of the receptacle 11. The upper surface of the engaging projection 15 is formed into a slanting surface 15*a* and the lower surface thereof is formed into a horizontal surface which acts as a locking portion 15*b*. Thus, when the movable member 3 is rotated to its locking position to move the locking portion 56 downward, the front end of the locking portion 56 is guided along the slanting surface 15*a* while undergoing elastic deformation and consequently slides under engaging projection 15, engaging the locking portion 15*b*.

Next, the action of this embodiment is described.

Figure 5:
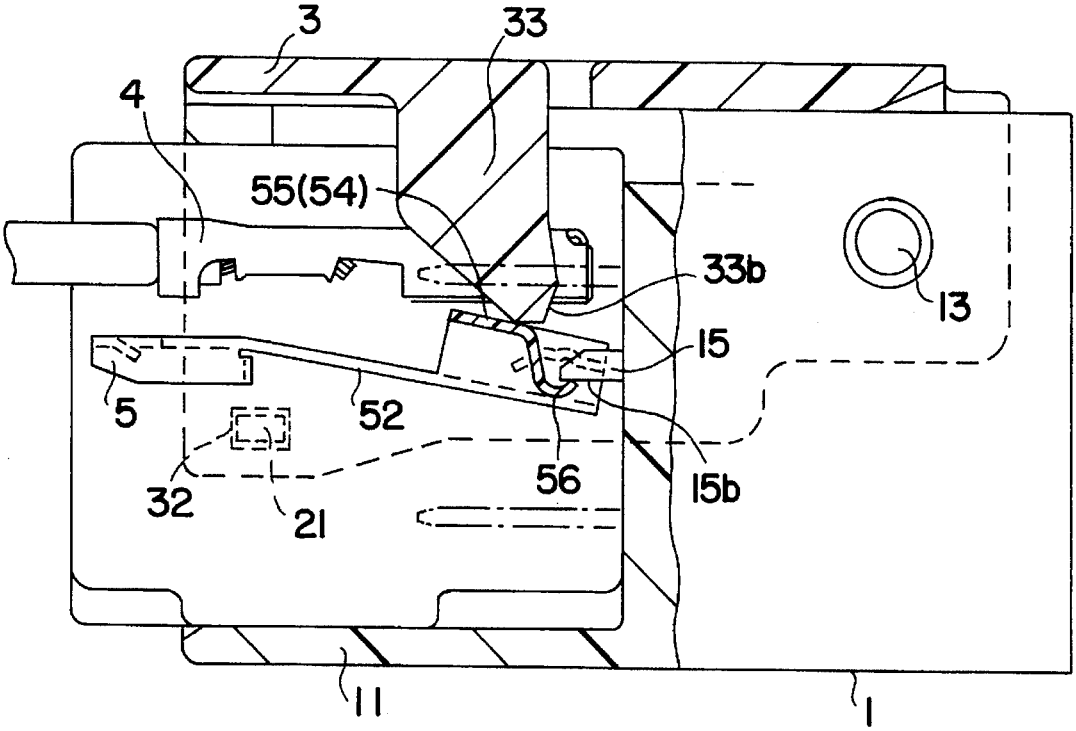
FIG. 5 is a section of the connector after the coupling is performed with the apparatus side connector housing omitted.
Figure 6:
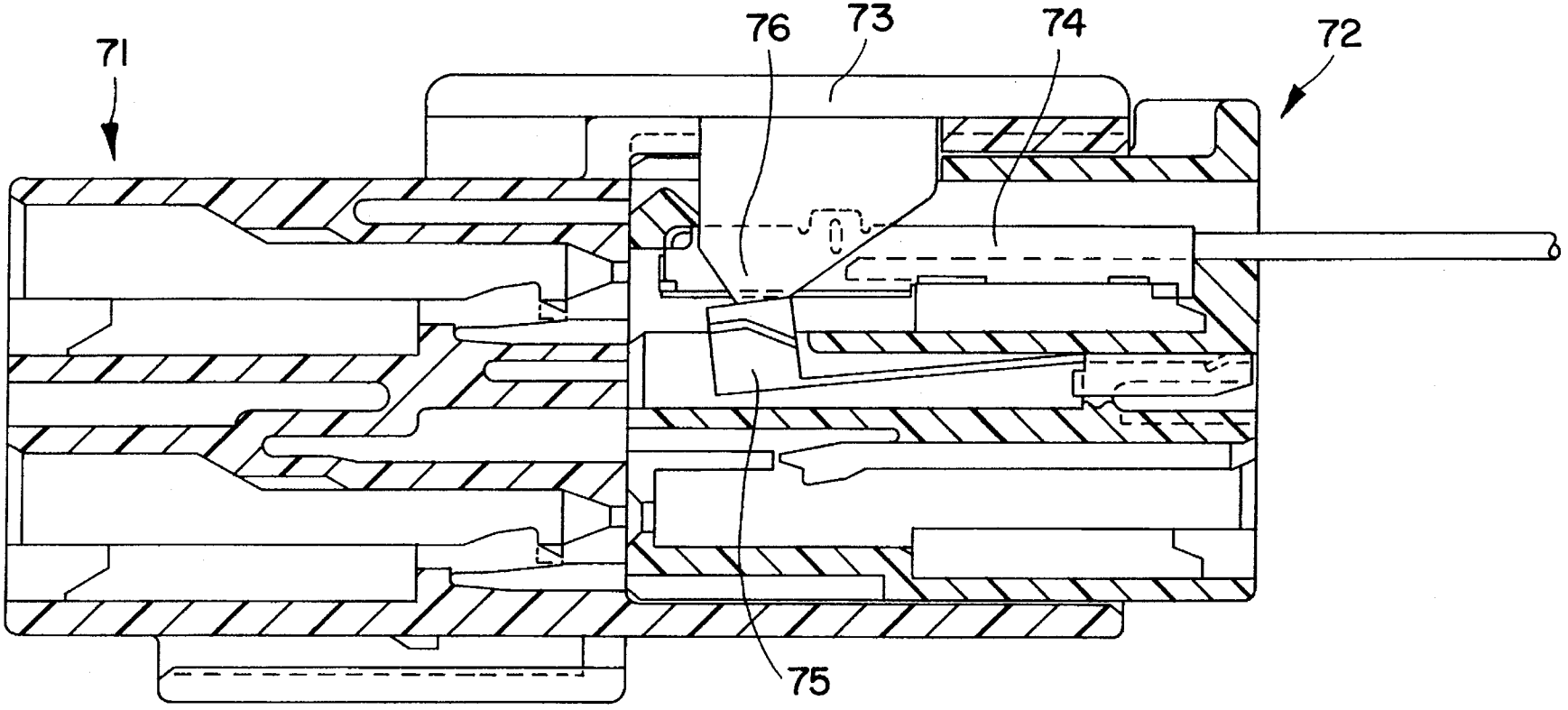
FIG. 6 PRIOR ART
FIG. 6 is a section of prior art connector.

When the movable member 3 is in its disengaged position as shown in FIG. 3, the contact portions 54 of the short-circuit terminal 5 are in contact with the lower surfaces of the supply terminals 4, thereby short-circuiting the terminals 4. When the movable member 3 is rotated to its locking position as shown in FIG. 5, the locking projections 21 are engaged with the locking holes 32, thereby coupling the connector housings 1 and 2. Since the pressing portion 33 enters the opening 22 while the slanting guide surface 33*b* thereof is guided by the engaging portion 23, the apparatus side connector housing 2 can be inserted until a specified coupling position in the receptacle 11 even if an initial insertion of the connector housing 2 is insufficient.

Figure 4:
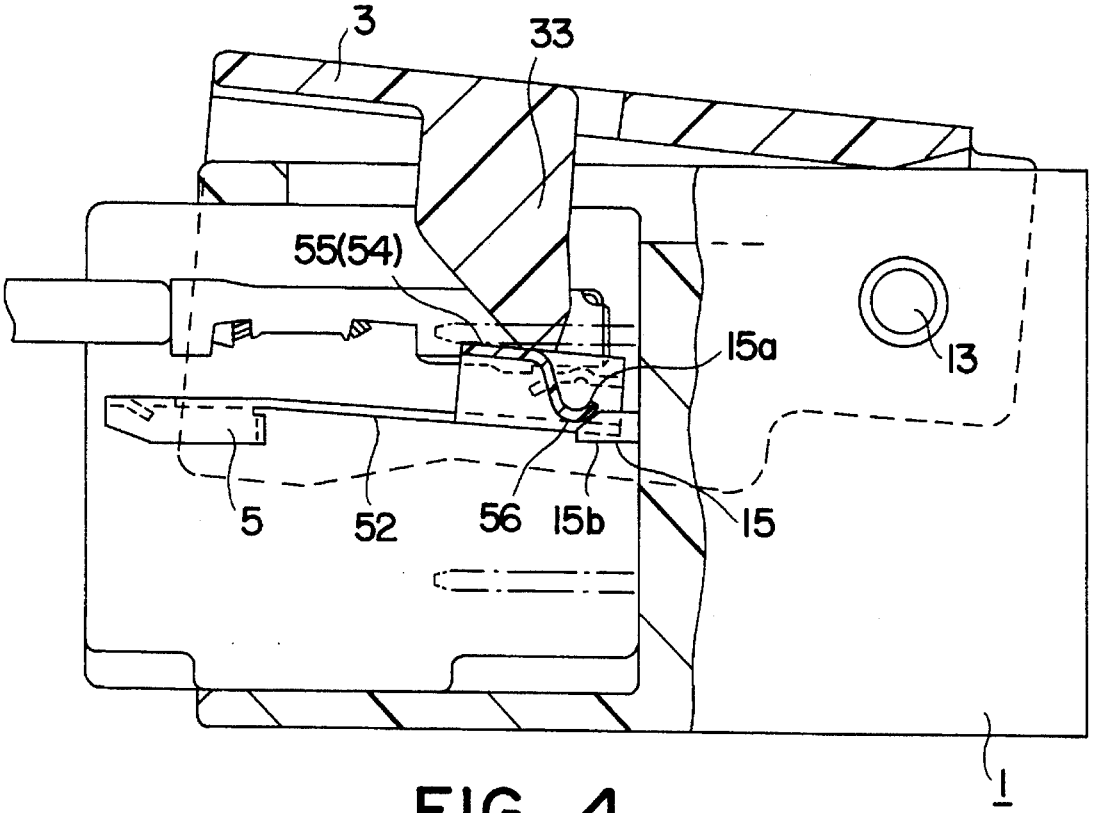
FIG. 4 is a section of the connector while the coupling is performed with the apparatus side connector housing omitted.

As the movable member 3 is rotated to its locking position, the pressing portion 33 comes into contact with the portion 55 of the short-circuit terminal 5 as shown in FIG. 4 and further causes the elastic arms 52 to deflect to move the connecting portion 53 downward, thereby releasing the short-circuited state of the supply terminals 4, 4. The leading end of the locking portion 56 is guided along the slanting surface 15*a* until it snaps under the locking portion 15*b*, and is held thereat. In this way, the connector is held in such a state as to enable the apparatus to properly operate upon receipt of a signal current from the power source when the connector housings 1 and 2 are coupled.

If the movable member 3 is brought out of its locking position or disengaged due to a certain external force, the pressing portion 33 cannot press the portion 55 of the short-circuit terminal. However, since the locking portion 56 is engaged with the engaging projection 15 and thus the portion 55 is kept pressed downward, the short-circuit terminal 5 is held out of contact with the supply terminals 4.

Thus, even in the event where the movable member 3 is disengaged, the apparatus is enabled to properly operate.

When conducting an inspection of a circuit, etc., the apparatus side connector housing 2 is withdrawn from the receptacle 11 to separate the connector housings 1 and 2 after the movable member 3 is rotated to its disengaged position. During this operation, the short-circuit terminal 5 is firstly held out of contact with the supply terminals 4 as described above, even after the movable member 3 is rotated to its disengaged position. Thereafter, as the apparatus side connector housing 2 is withdrawn from the receptacle 11, the locking portion 56 is disengaged from the engaging projection 15, with the result that the contact portions 54 of the short-circuit terminal 5 move upward due to its elasticity and come into contact with the supply terminals 4. Thereby, the supply terminals 4, 4 are short-circuited again by the short-circuit terminal 5. Thus, an induced current caused by external magnetic and electric fields does not flow into circuits provided in the apparatus, thereby preventing an erroneous operation of the apparatus.

As described above, according to the connector of this embodiment, even if a function of pressing the short-circuit terminal 5 in such a direction as to release the short-circuited state is lost, e.g., in the event where the movable member 3 is disengaged, the short-circuited state can remain released by engagement of the locking portion 56 with the locking projection 15. Thus, an erroneous operation of the apparatus caused by the short-circuited supply terminals 4 can be prevented.

The invention is not limited to the foregoing embodiment, but may be embodied, for example, as follows.

(1) The connector housings 1 and 2 are coupled by means of the movable member 3 in the foregoing embodiment. However, another or additional coupling means may be provided by forming a hole and a projection engageable with the hole in one and the other of the apparatus side connector housing and the supply side connector housing. With this coupling means, the connector housings are held coupled even if the movable member 3 is disengaged and thus the short-circuited state can be released more securely.

(2) The locking portion 56 of the short-circuit terminal 5 is engaged with the engaging projection 15 of the supply side connector housing 1 in the foregoing embodiment. According to the invention, any means will do as long as it is capable of releasing the short-circuited state when the connector housings are coupled. For example, a locking recess may be formed in the supply side connector housing which recess is engageable with the leading end of the short-circuit terminal. Another means may be suitably selected and embodied.

What is claimed is:

1. A connector comprising an apparatus side connector housing (2) in which (+)- and (−)-supply terminals (4, 4) and a short-circuit terminal (5) for bringing the supply terminals (4, 4) into a short-circuited state are mounted, a supply side connector housing (1), and a movable member (3) which is movably mounted with respect to the connector for pressing the short-circuit terminal (5) to release the short-circuiting state, wherein:

an engaging portion (15) is formed at the supply side connector housing (1) for retaining the release state of the short-circuit terminal (5) as long as the connector housings (1, 2) are coupled.

2. A connector according to claim 1, wherein the engaging portion is an engaging projection (15).

3. A connector according to claim 2, wherein the engaging projection (15) projects from an inner surface of a case (11) of the supply side connector housing (1), into which the apparatus side connector housing (2) is inserted, so that the engaging projection (15) is located below the short-circuit terminal (5) in its short-circuiting state.

4. A connector according to claim 1, wherein the short-circuit terminal (5) has short-circuit contact portions (54, 54) which are resiliently deflectable from the short-circuiting state to the release state.

5. A connector according claim 1, wherein the short-circuit terminal (5) comprises a contact portion (55) with which the movable member (3) comes into contact for releasing the short-circuiting state, and a locking portion (56) for lockingly engaging the engaging portion (15) in the release state.

6. A connector according to claim 5, wherein the locking portion is a tongue (56) extending from the contact portion (55).

7. A connector according to claim 6, wherein the tongue (56) extends from the contact portion (55) obliquely downward and is formed such that its front end inclines upward.

8. A connector according to claim 1, wherein the movable member (3) is rotatably mounted on the supply side connector housing (1) and comprises a pressing portion (33) extending downwardly through a groove (14) in the supply side connector housing (1) and through an opening (22) in the apparatus side connector housing (2).

9. A connector according to claim 8, wherein the connector is formed with coupling means (21, 32; 23, 33) for coupling the apparatus side connector housing (2) with the supply side connector housing (1).

10. A connector according to claim 9, wherein the pressing portion (33), for coupling the apparatus side connector housing (2) and the supply side connector housing (1), engages an engaging portion (23) formed at the opening (22) of the apparatus side connector housing (2).

* * * * *